US009663269B1

(12) United States Patent
Lasris

(10) Patent No.: US 9,663,269 B1
(45) Date of Patent: May 30, 2017

(54) SYSTEM OF NESTING STORAGE LIDS AND CONTAINERS

(71) Applicant: Roy Lasris, Seaford, VA (US)

(72) Inventor: Roy Lasris, Seaford, VA (US)

( * ) Notice: Subject to any disclaimer, the term of this patent is extended or adjusted under 35 U.S.C. 154(b) by 2 days.

(21) Appl. No.: 15/011,699

(22) Filed: Feb. 1, 2016

Related U.S. Application Data

(60) Provisional application No. 62/110,788, filed on Feb. 2, 2015.

(51) Int. Cl.
*A47G 19/23* (2006.01)
*B65D 21/02* (2006.01)
*B65D 43/02* (2006.01)

(52) U.S. Cl.
CPC ..... *B65D 21/0233* (2013.01); *A47G 19/23* (2013.01); *B65D 43/0225* (2013.01)

(58) Field of Classification Search
CPC ..... B65D 43/0225; B65D 21/0233; B65D 21/0234; A47G 19/23
USPC ..... 220/380, 212; 206/515
See application file for complete search history.

(56) References Cited

U.S. PATENT DOCUMENTS

| | | | |
|---|---|---|---|
| 4,076,123 | A | 2/1978 | Davis |
| 4,364,476 | A | 12/1982 | Weller et al. |
| 5,881,880 | A | 3/1999 | Jacques et al. |
| 7,264,135 | B2 | 9/2007 | Savicki et al. |
| 7,726,483 | B2 | 6/2010 | Ramanujam et al. |
| 2003/0183641 | A1 | 10/2003 | Asbury |
| 2007/0235963 | A1 | 10/2007 | Killinger et al. |
| 2013/0161221 | A1 | 6/2013 | Furlong |

OTHER PUBLICATIONS

GladWare Entrée. Product Listing [online]. Glad, 2011 [retrieved on Nov. 11, 2014]. Retrieved from the Internet: http://www.soap.com/p/gladware-entree-5ct-73736?site=CA&sku=CXC-043&utm_source=Google&utm_medium=cpc_S&utm_campaign=GooglePLA&utm_content=pla&ca_sku=CXC-043&ca_gpa= pla&ca_kw=&CAWELAID=1323102240&kpid=CXC-043.

*Primary Examiner* — Stephen Castellano
(74) *Attorney, Agent, or Firm* — Robert C. Montgomery; Montgomery Patent & Design, LP.

(57) ABSTRACT

A container and lid system is designed to nest and positively attach to other identically sized portions. Stacks of containers and lids are subsequently connected together to form a unitary stack which provides compact storage and organization of the system. The container and lid portions of the system may be configured with various complementing an integrally-molded features which enable engagement and retention thereof.

20 Claims, 6 Drawing Sheets

SYSTEM OF NESTING STORAGE LIDS AND CONTAINERS

RELATED APPLICATIONS

This application claims the benefit of U.S. Provisional Application No. 62/110,788, which was filed Feb. 2, 2015, the entire disclosures of which are incorporated herein by reference.

FIELD OF THE INVENTION

The present invention relates generally to a container and lid system designed to nest and attach to other identically sized portions.

BACKGROUND OF THE INVENTION

A peek inside of most kitchen cabinets and cupboards in most homes would reveal an unorganized wealth of plastic storage containers. While these containers do an admirable job of keeping food and leftovers fresh, they do have significant drawbacks. The most significant drawback being the containers numerous sizes make it often difficult to quickly find a matching lid.

While the containers are usually of a tapered design and can be stacked, the lids are not, and are simply tossed together in a loose state. This leads to wasted space, a disorganized appearance and perhaps most notably, it leads to personal frustration and aggravation when trying to find a lid to place on a container of food. Accordingly, there exists a need for a means by which empty food containers and lids can be more easily stored in an improved and streamlined manner without the disadvantages as described above. The use of the system provides a means to store empty plastic food containers in an organized state that uses all available storage space while at the same time reducing confusion and chaos.

SUMMARY OF THE INVENTION

The inventor has recognized the aforementioned inherent problems and lack in the art and observed that there is a need for a container and lid system designed to nest and attach to other identically sized portions.

It is therefore the purpose of the inventor to provide a nesting container and lid system comprising a plurality of containers and a plurality of lids. Each container has an open container top, a container locking feature, a closed container bottom and a container sidewall tapering downward in diameter from the container top to the container bottom, thereby defining an interior. Each lid has a lid body, an interior lid locking feature, a lid rim located on an exterior side of the interior lid locking feature and an exterior lid locking feature located subjacent to the interior lid locking feature and the lid rim.

Each individual container is capable of being nested within a separate individual superjacent or subjacent container. Each interior lid locking feature of each lid is capable of being secured to the container locking feature of an individual container to seal the interior. The interior lid locking feature of each lid is capable of being secured to the exterior lid locking feature of a superjacent or subjacent lid. The plurality of containers and lids may be made of a plastic which is capable of being reused. The containers may be either drinking vessels or bowls. The locking features of each container and lid may be integrally molded.

In the preferred embodiment, the container locking feature further comprises a male thread circumscribing an exterior upper perimeter edge of the container top and extending annularly about the exterior upper perimeter edge. The interior lid locking feature further comprises a female thread circumscribing an interior perimeter edge of each the lid body and extending about the interior perimeter edge. The exterior lid locking feature further comprises a male thread circumscribing an exterior perimeter edge of the lid body and extending about the perimeter edge. Thus, the container locking feature of the preferred embodiment is capable of being threadingly secured to the interior lid locking feature while the interior lid locking feature is capable of being threadingly secured to the exterior lid locking feature.

In an alternate embodiment, the container locking feature further comprises a first fastener, the interior lid locking feature comprises a second fastener and the exterior lid locking feature comprises a third fastener. Thus, the container locking feature of the alternate embodiment is capable of being secured to the interior lid locking feature while the interior lid locking feature is capable of being friction fit secured to the exterior lid locking feature.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
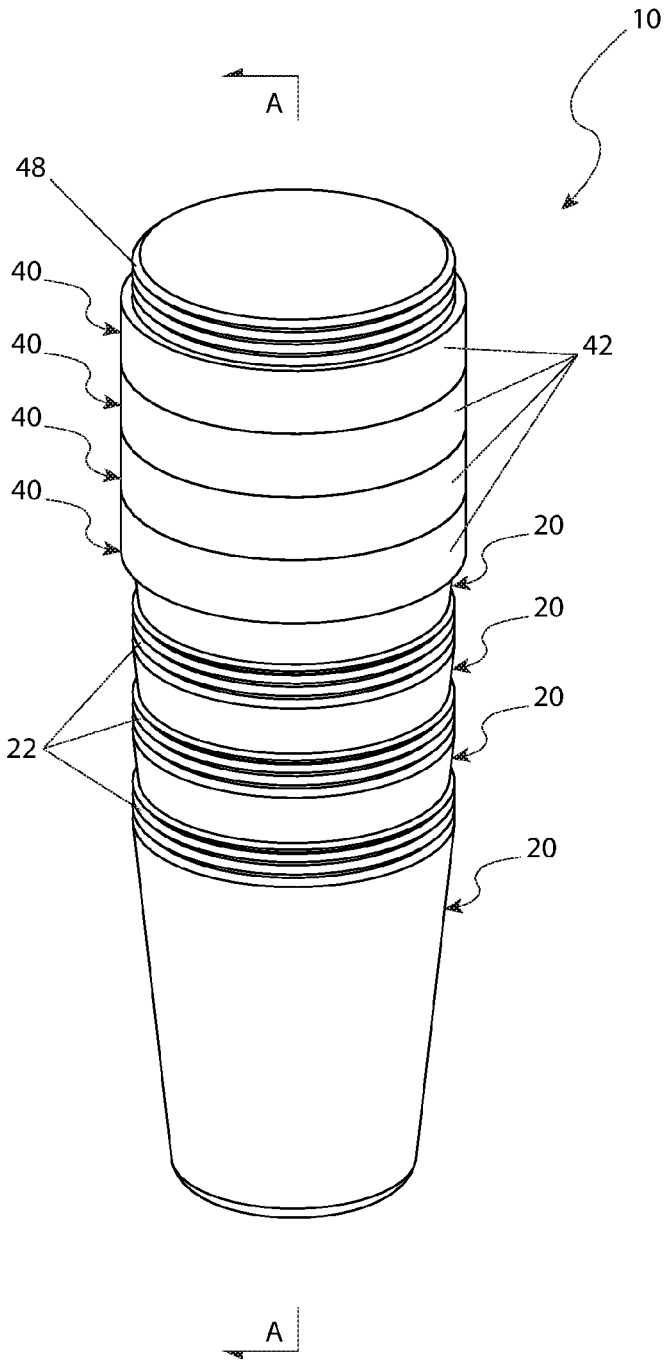
FIG. 1 is a perspective view of a nesting lid and container system 10, according to a preferred embodiment of the present invention.

10 nesting lid and container system
15 container closed bottom
17 container open top
19 container sidewall
20 container
22 container locking feature
40 lid
42 lid rim
44 interior lid locking feature
48 exterior lid locking feature
100 alternate system
120 alternate container
122 alternate container locking feature
124 alternate container closed bottom
126 alternate container open top

128 alternate container sidewall
140 alternate lid
142 alternate lid rim
144 alternate lid locking feature
148 lid locking groove

DETAILED DESCRIPTION OF THE PREFERRED EMBODIMENT

Figure 2:
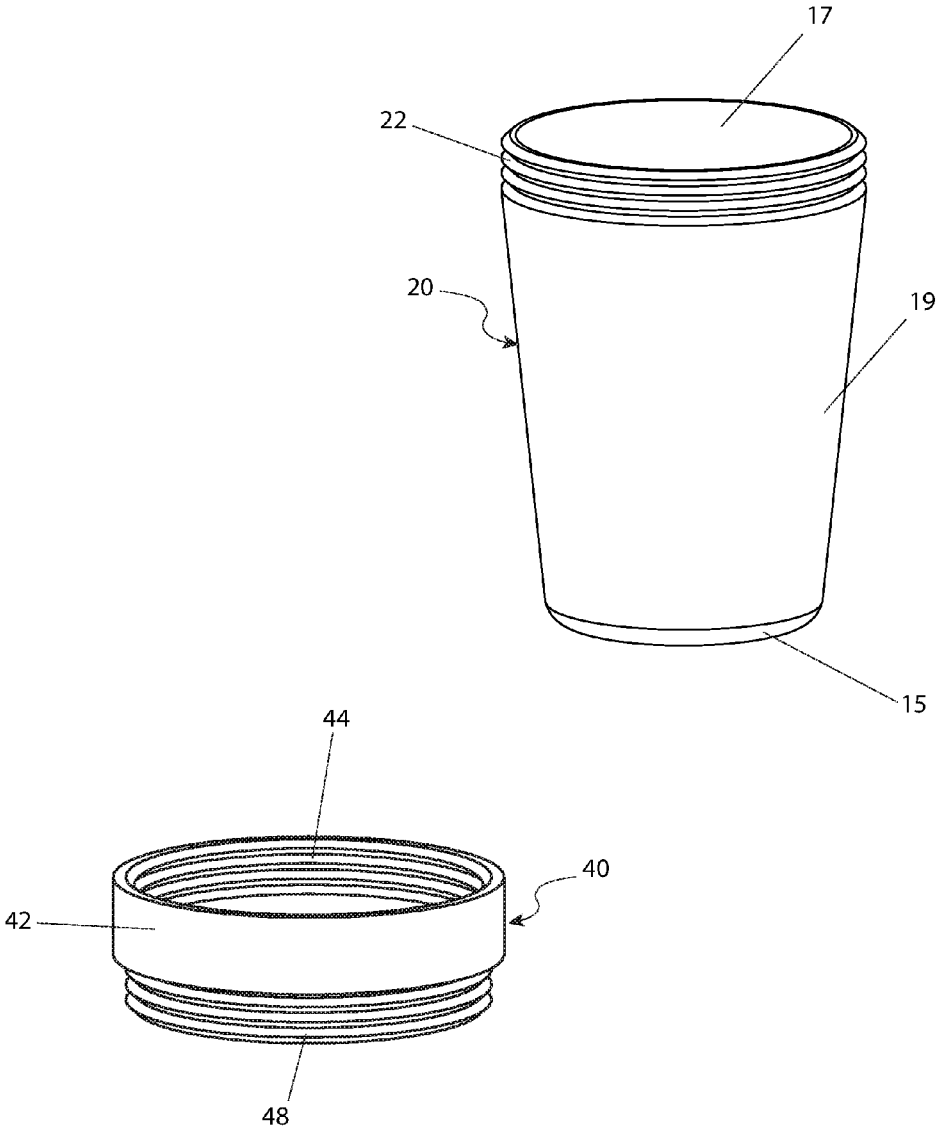
FIG. 2 is a perspective view of container 20 and a lid 40, according to a preferred embodiment of the present invention.
Figure 3:
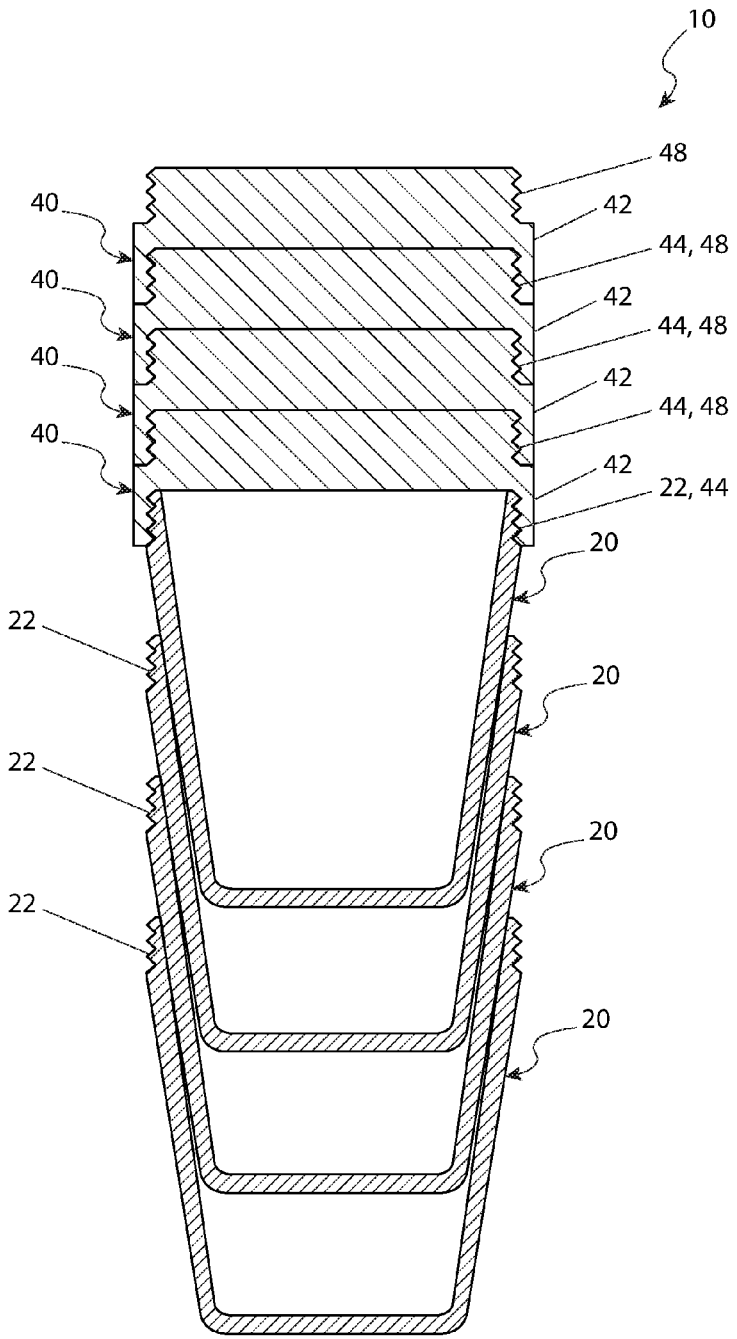
FIG. 3 is a sectional view of the nesting lid and container system 10 taken along section line A-A (see FIG. 1), according to a preferred embodiment of the present invention.
Figure 4:
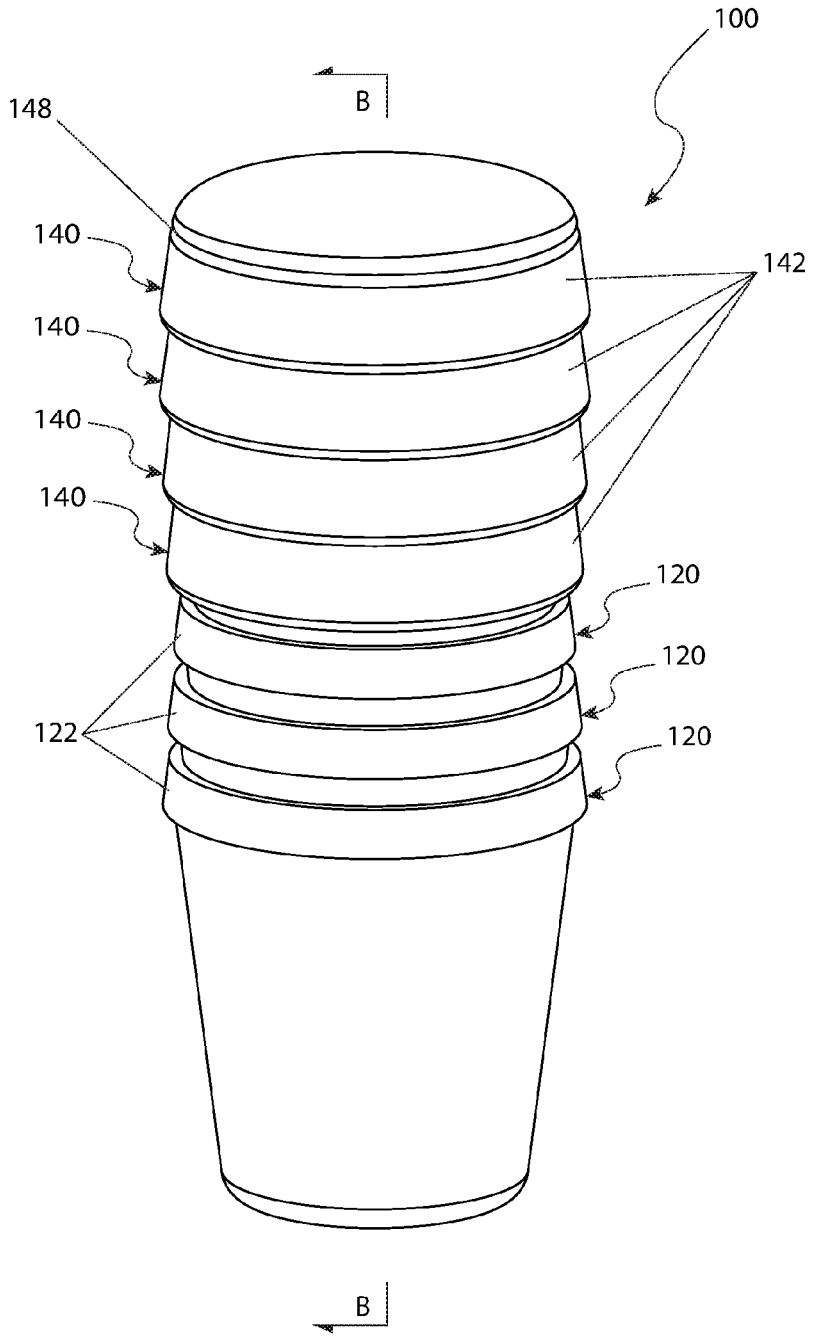
FIG. 4 is a perspective view of an alternate system 100 of the invention depicting a stacked state, according to an alternate embodiment of the present invention.
Figure 5:
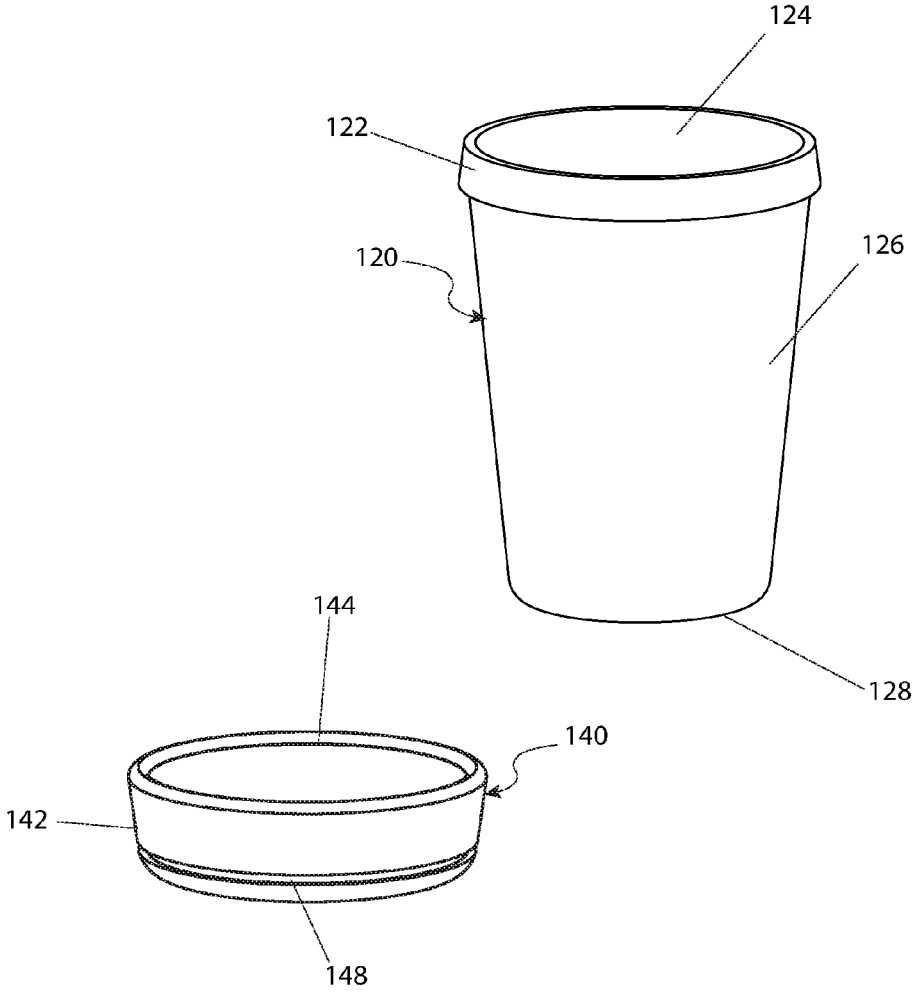
FIG. 5 is a perspective view of an alternate container 120 and an alternate lid 140; and, FIG. 6 is a sectional view of the alternate system 100 taken along section line B-B (see FIG. 4), according to an alternate embodiment of the present invention.
Figure 6:
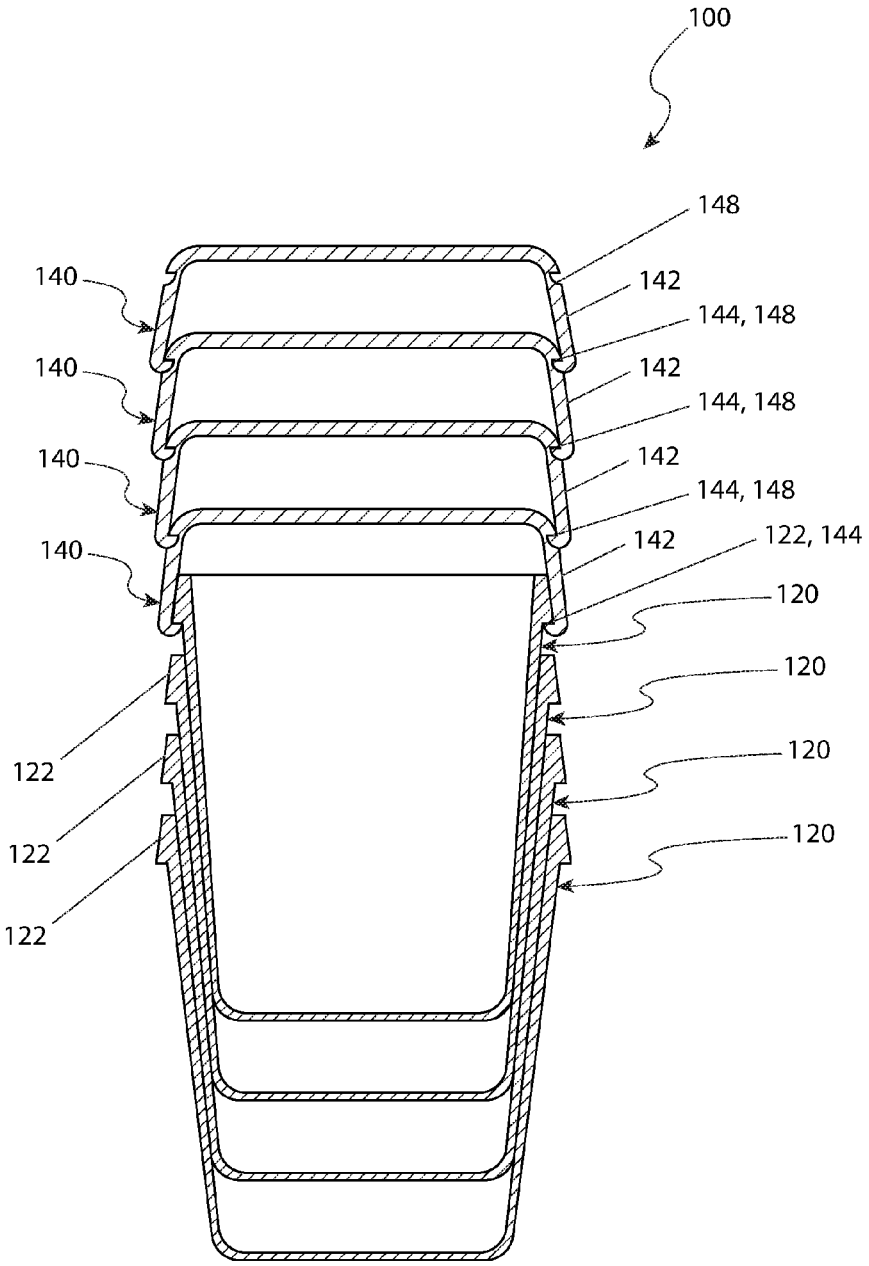

The best mode for carrying out the invention is presented in terms of its preferred embodiment, herein depicted within FIGS. 1 through 3, and in terms of an alternate embodiment, herein depicted within FIGS. 4 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a nesting lid and container system (herein described as the "system") 10, which provides for stacked storage of multiple empty containers 20 together with their lids 40 as one (1) unit. The attaching and stacking of the containers 20 and lids 40 allows convenient storage in a drawer or cabinet in a combined manner without worry of the containers 20 or lids 40 becoming separated, resulting in disorganization, confusion, and a messy appearance. As the containers 20 and lids 40 are emptied and washed, they are simply added back to the bottom and top of the stack respectively.

Referring now to FIGS. 1 through 3, perspective and sectional views of the system 10, according to the preferred embodiment of the present invention, are disclosed. The system 10 provides an attachment and stacking means to specially-designed plastic reusable containers 20 and lids 40 via connecting features being incorporated into a plastic molding manufacturing process. A typical design of a container 20 and corresponding locking lid 40 are shown here for illustration sake; however, it is understood that the teachings of the invention may be incorporated into various sized and shaped containers 20 utilizing various engagement methods, and as such should not be interpreted as a limiting factor of the invention.

The embodiment of the container 20 shown in FIG. 2 provides integrally-molded portions including a tapered cup-shaped body portion which provides a friction fit attachment between adjacent containers 20 when stacked. Each container 20 further includes a closed container bottom 15, a container open top 17, a container sidewall 19 and a male threaded container locking feature 22 which extends in an annular manner all along a top exterior annular edge of the container 20. The container locking feature 22 is designed to mechanically retain a corresponding female threaded interior lid locking feature 44 molded into an inner bottom edge of a lid rim 42 of the lid 40. Each lid 40 also possess a male threaded exterior lid locking feature 48 located subjacent to said interior lid locking feature 44 and said lid rim 42. The interior lid locking feature 44 of each lid rim 42 retains superjacent and subjacent lid's 40 exterior lid locking feature 48 when engaged with each other as seen here.

Additionally, the aforementioned features of the system 10 allow the top-most container 20 in the stack of containers 20, to be threadingly engaged with the bottom-most lid 40 in the stack of lids 40, thereby resulting in a combined and organized unit as seen in FIG. 1.

It is envisioned that other styles and configurations of containers 20 and lids 40 which utilize various other interlocking and stacking features 22, 44 and 48 inside and outside annular rings, and the like, can be incorporated into the teachings of the system 10, and that only one (1) particular configuration is shown and described herein for purposes of clarity and disclosure, and not by way of limitation of scope.

Referring now to FIGS. 3 and 4, a perspective view of an alternate system 100 of the invention, is disclosed. The alternate system 100 includes alternate containers 120 and alternate lids 140 which snap together. The alternate containers 120 includes an alternate closed container bottom 124, an alternate container open top 126, an alternate container sidewall 128 provide tapering cup-shaped body portions which provides a friction fit attachment between adjacent alternate containers 120 when stacked. Each alternate container 120 further includes an alternate container locking feature 122 which extends in an annular manner outwardly all along a top circular edge of the alternate container 120. The alternate container locking feature 122 is designed to mechanically retain a corresponding and oppositely biased alternate lid locking feature 144 molded into an inner bottom edge portion of an alternate lid rim portion 142 of the alternate lid 140. The embodiment of the alternate lid 140 shown in FIG. 5 provides a lid locking groove 148 formed in the alternate lid rim 142 in an annular manner which provides snapping engagement with the alternate lid locking feature 144 to retain superjacent and subjacent alternate lids 140 when stacked upon each other as seen here.

The preferred embodiment of the present invention can be utilized by the common user in a simple and effortless manner with little or no training. After initial purchase or acquisition of the system 10, it would be provided as indicated in FIG. 2 and capable of being joined as illustrated in FIG. 1.

The method of utilizing the system 10 may be achieved by performing the following steps: procuring an embodiment of the system 10 including a plurality of containers 20 and corresponding lids 40; preparing the system 10 for storage, until needed, by securing the containers 20 together by inserting the body portions of the containers 20 together and allowing the friction fit between the containers 20 to retain the containers 20 in a stacked form; engaging the lid rim portions 42 of the lids 40 and allowing the threaded lid locking features 44 to engage corresponding lid locking features 44; configuring the containers 20 and lids 40 into a single unit by threadingly engaging and attaching the bottom-most lid 40 in the stack of lids 40 to the top-most container 20 in the stack of containers 20 via respective lid locking feature 44 and container locking feature 24 portions; placing the system 10 into a drawer or cabinet until needed; removing a container 20 and lid 40 combination from the system 10 by disengaging the top-most lid 40 and the bottom-most container 20 from the stack; utilizing the container 20 and lid 40 in a normal manner to contain, transport, and consume a contained food or drink; returning the remaining portions of the system 10 to the drawer or cabinet; and, avoiding normal separation and disorganization of conventional containers and lids, afforded a user of the present invention 10.

As the containers 20 and lids 40 are utilized, emptied, and washed, they are simply added back to the bottom and top of the stacked system 10, respectively.

The method of utilizing the alternate system 100 would be accomplished in a similar manner as the preferred embodiment 10, as provided in FIG. 5 and capable of being stacked as illustrated in FIG. 4.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A nesting container and lid system comprising:
a plurality of containers, each comprising:
an open container top;
a container locking feature;
a closed container bottom; and,
a container sidewall tapering downward in diameter from said container top to said container bottom, thereby defining an interior;
a plurality of lids, each comprising:
a lid body;
an interior lid locking feature;
a lid rim located on an exterior side of said interior lid locking feature; and,
an exterior lid locking feature located subjacent to said interior lid locking feature and said lid rim;
wherein an individual container is capable of being nested within a separate individual superjacent or subjacent container;
wherein said interior lid locking feature of each said lid is capable of being secured to said container locking feature of an individual container to seal said interior; and,
wherein said interior lid locking feature of each said lid is capable of being secured to said exterior lid locking feature of a superjacent or subjacent lid.

2. The system of claim 1, wherein said container locking feature further comprises a male thread circumscribing an exterior upper perimeter edge of said container top and extending annularly thereabout.

3. The system of claim 2, wherein said interior lid locking feature further comprises a female thread circumscribing an interior perimeter edge of said lid body and extending thereabout.

4. The system of claim 3, wherein said exterior lid locking feature further comprises a male thread circumscribing an exterior perimeter edge of said lid body and extending annually thereabout;
wherein said container locking feature is capable of being threadingly secured to said interior lid locking feature; and,
wherein said interior lid locking feature is capable of being threadingly secured to said exterior lid locking feature.

5. The system of claim 1, wherein said plurality of containers comprise a plastic construction capable of reuse.

6. The system of claim 1, wherein said plurality of lids comprise a plastic construction capable of reuse.

7. The system of claim 1, wherein said plurality of containers are drinking vessels.

8. The system of claim 1, wherein said plurality of containers are bowls.

9. The system of claim 1, wherein said container locking feature is integrally molded.

10. The system of claim 9, wherein said interior and exterior lid locking features are integrally molded.

11. A nesting container and lid system comprising:
a plurality of containers, each comprising:
an open container top;
a container locking feature comprising a first fastener;
a closed container bottom; and,
a container sidewall tapering downward in diameter from said top to said closed bottom, thereby defining an interior;
a plurality of lids, each comprising:
a lid body;
an interior lid locking feature comprising a second fastener;
a lid rim located on an exterior side of said interior lid locking feature; and,
an exterior lid locking feature comprising a third fastener located subjacent to said interior lid locking feature and said lid rim;
wherein an individual container is capable of being nested within a separate individual superjacent or subjacent container;
wherein said interior lid locking feature of each said lid is capable of being secured to said container locking feature of an individual container to seal said interior; and,
wherein said interior lid locking feature of each said lid is capable of being secured to said exterior lid locking feature of a superjacent or subjacent lid.

12. The system of claim 11, wherein said first fastener further comprises a lip circumscribing an exterior upper perimeter edge of said container top and extending annularly thereabout.

13. The system of claim 12, wherein said second fastener further comprises a lip circumscribing an interior perimeter edge of said lid body and extending annularly thereabout.

14. The system of claim 13, wherein said third fastener further comprises a groove circumscribing an exterior perimeter edge of said lid body and extending annularly thereabout;
wherein said container locking feature is capable of being secured to said interior lid locking feature; and,
wherein said interior lid locking feature is capable of being secured to said exterior lid locking feature.

15. The system of claim 11, wherein said plurality of containers comprise a plastic construction capable of reuse.

16. The system of claim 11, wherein said plurality of lids comprise a plastic construction capable of reuse.

17. The system of claim 11, wherein said plurality of containers are drinking vessels.

18. The system of claim 11, wherein said plurality of containers are bowls.

19. The system of claim 11, wherein said container locking feature is integrally molded.

20. The system of claim 19, wherein said interior and exterior lid locking features are integrally molded.

* * * * *